US006912291B2

(12) United States Patent
Huang

(10) Patent No.: US 6,912,291 B2
(45) Date of Patent: Jun. 28, 2005

(54) STRUCTURE OF A RECEPTACLE FOR EARPHONE WIRE

(76) Inventor: Fang Tien Huang, PO Box 82-144, Taipei (TW)

( * ) Notice: Subject to any disclaimer, the term of this patent is extended or adjusted under 35 U.S.C. 154(b) by 658 days.

(21) Appl. No.: 09/973,062

(22) Filed: Oct. 10, 2001

(65) Prior Publication Data

US 2003/0068062 A1 Apr. 10, 2003

(51) Int. Cl.[7] ..... H04R 25/00
(52) U.S. Cl. ..... 381/374; 381/379; 381/384
(58) Field of Search ..... 381/374, 376, 381/380, 371, 384, 370; 379/430, 438; 242/385.4, 378.4, 400.1, 405.2

(56) References Cited

U.S. PATENT DOCUMENTS 5,339,461 A * 8/1994 Luplow ..... 242/385
5,684,883 A * 11/1997 Chen ..... 381/385
6,371,398 B1 * 4/2002 Liao ..... 242/378.1
6,434,249 B1 * 8/2002 Wei ..... 381/370

* cited by examiner

*Primary Examiner*—Curtis Kuntz
*Assistant Examiner*—Brian Ensey
(74) *Attorney, Agent, or Firm*—Leong C. Lei

(57) ABSTRACT

An improved structure of a receptacle for earphone wire is disclosed. The present receptacle for an earphone wire is characterized in that the front shell contains a switching button, an interconnection rod urged against the switching button and a swinging rod which can actuate the rolling disc, and a pulling rod passed through the front shell capable of triggering the interconnection rod is provided to the clipping hook, the earphone seat is provided with a pushing rod pivotally mounted at the front shell, and the pushing rod passes through the front shell and interconnects with the swinging rod to swing, thereby the withdrawing out or inserting in the earphone can control the switching button of the earphone or the rotating of the rolling disc so that the earphone can be automatically switched ON or switched OFF.

7 Claims, 9 Drawing Sheets

STRUCTURE OF A RECEPTACLE FOR EARPHONE WIRE

BACKGROUND OF THE INVENTION (a) Technical Field of the Invention

The present invention relates to an improved structure of a receptacle for earphone wire, and in particular, a receptacle for earphone wire allowing automatic switching ON and OFF of the earphone.

(b) Description of the Prior Art

FIG. 1 shows a conventional receptacle for earphone cord comprising a front shell 1 and a rear shell 2, a retractable earphone cord 40 and a retracting device 3. A retractable spring 32 located within the retractable device 3 causes a driving disc 31 to rotate and the earphone cord 40 is rolled and collected within the receptacle. However, the contact between a contacting disc 330 and a conductive disc 304 within the receptacle causes wears and thus the longevity of the conventional receptacle is reduced. FIGS. 2 and 3 show a conventional receptacle for earphone wire, wherein when an earphone 4 is pressed into a notch 191 provided on the earphone seat 19, the hook 193 extends outward and the restoration force of the hook 193 restricts and positions the earphone 4 to the earphone seat 19. In this conventional structure, the earphone 4 has to be pressed into the earphone seat 19 and a push button is pushed so that the earphone wire 40 can be retained into the receptacle. It is troublesome with respect to operation, and further, there is no power switch provided to the receptacle or no separation of power switch, therefore it is very often that the power switch is not turned off when the earphone is not in used. Accordingly, it is an object of the present invention to provide an improved structure of a receptacle for earphone wire which mitigates the above drawbacks, and provides an automatic switching ON and OFF.

SUMMARY OF THE INVENTION

Accordingly, it is an object of the present invention to provide an improved structure of a receptacle for earphone wire having a front shell and a rear shell, and a rolling disc, wherein the front shell contains a switching button, an interconnection rod urged against the switching button and a swinging rod which can actuate the rolling disc, and a pulling rod passed through the front shell capable of triggering the interconnection rod is provided to a clipping hook, the earphone seat is provided with a pushing rod pivotally mounted at the front shell, and the pushing rod passes through the front shell and interconnects with the swinging rod, thereby the withdrawing out or inserting in the earphone can control the switching button of the earphone or the rotating of the rolling disc so that the earphone can be automatically switching on or switching off.

Yet another object of the present invention is to provide an improved structure of a receptacle for earphone wire, wherein a shaft axle is provided to the front shell allowing the pivotal mounting of the rolling disc, the earphone wire and the connection wire pass through the top hole and the bottom hole provided on the top and bottom end of the front shell, a sliding hole is provided to the front shell along the pulling rod to pass through and slide within the sliding hole, and a pivot hole is provided to the front shell for the pivotal mounting of the pushing rod, and the interconnection rod is pivotally mounted on the inner side of the front shell.

A further object of the present invention is to provide an improved structure of a receptacle for earphone wire, wherein a clipping body is provided to the receptacle for mounting onto a belt of the user, and a top and bottom holes are respective formed at the top end and bottom end of the combination of the front shell and the bottom shell allowing the earphone wire and the connection wire to pass through.

Other object and advantages of the present invention will become more apparent from the following description taken in conjunction with the accompanying drawing.

DETAILED DESCRIPTION OF THE PREFERRED EMBODIMENT

Figure 1:
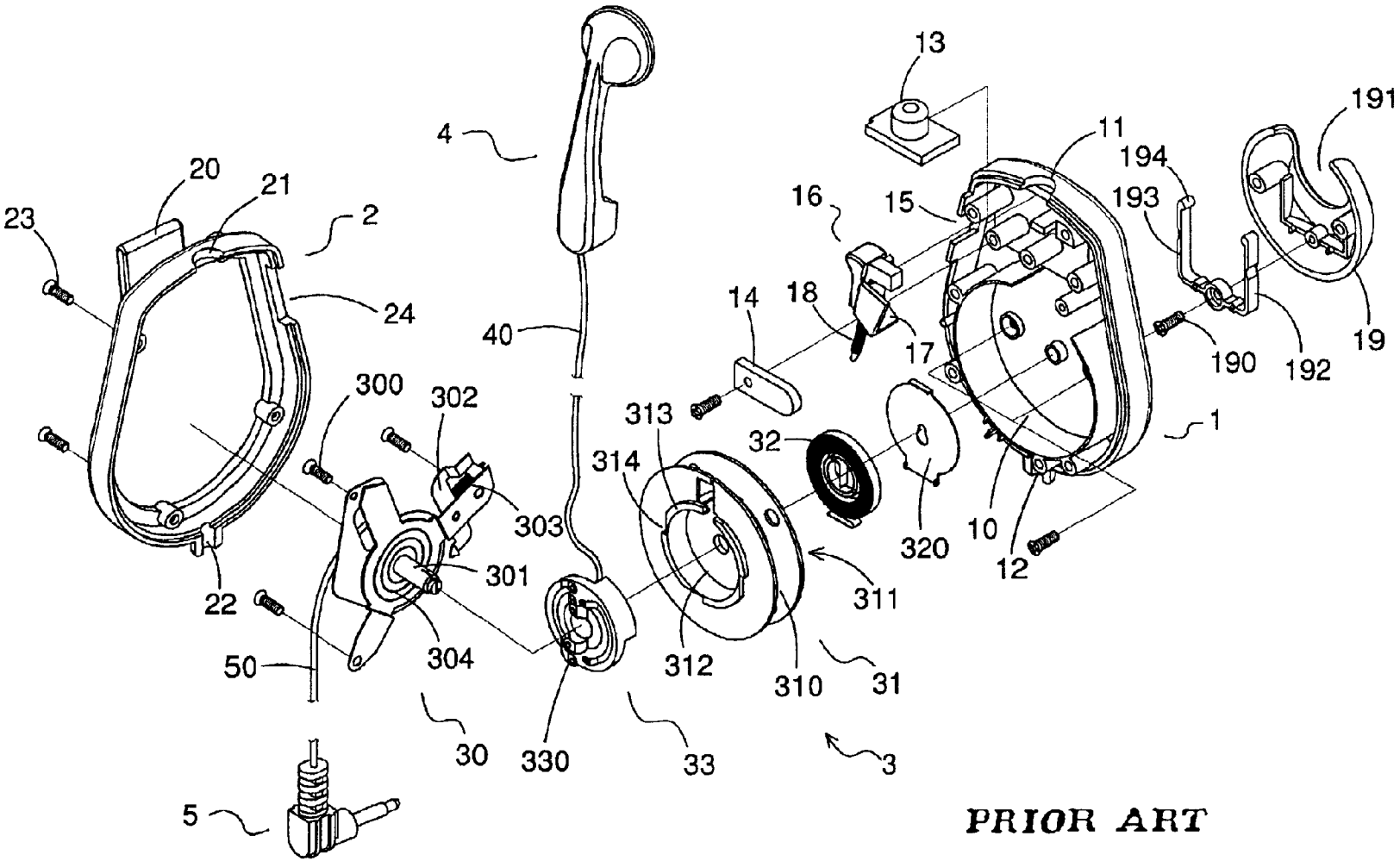
PRIOR ART FIG. 1
FIG. 1 is a perspective exploded view of a conventional receptacle for earphone cord.
Figure 2:
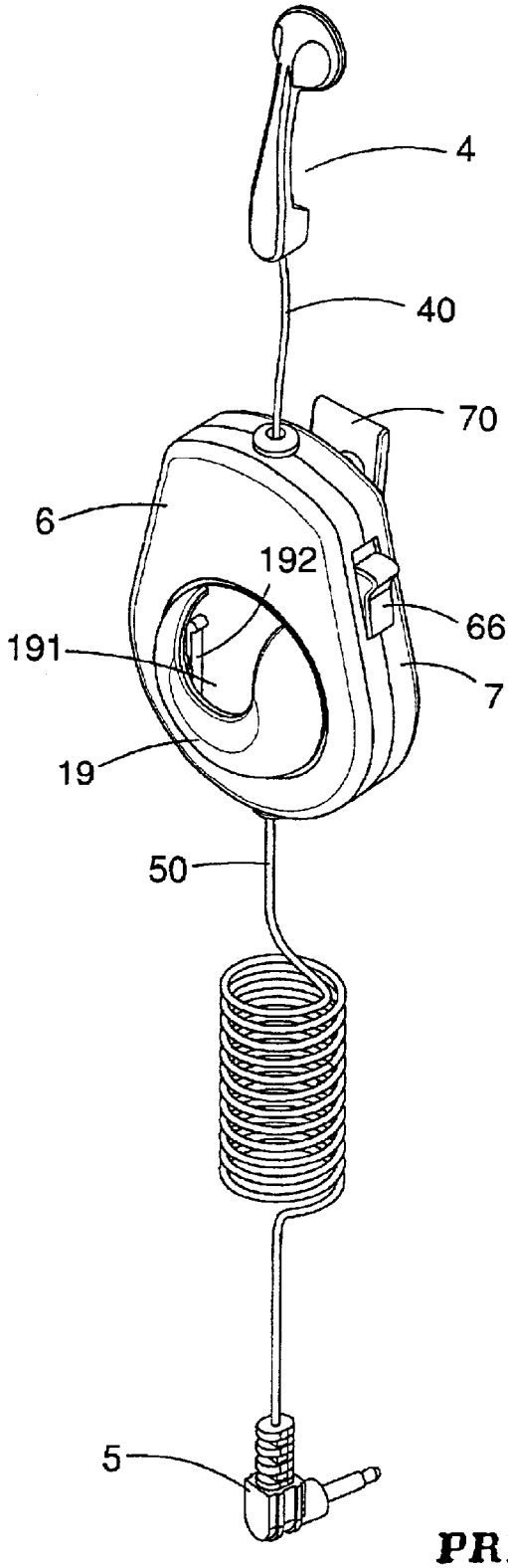
PRIOR ART FIG. 2
FIG. 2 is a perspective view of a conventional receptacle for earphone cord.
Figure 3:
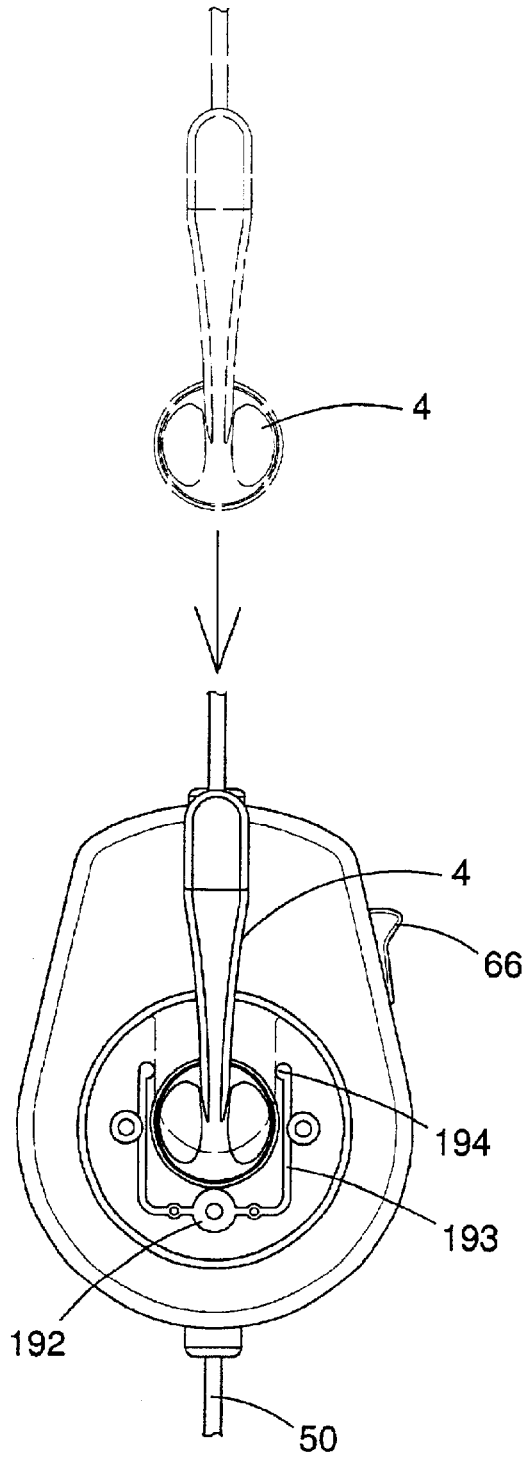
PRIOR ART FIG. 3
FIG. 3 schematically shows the implementation of the conventional receptacle for earphone cord.
Figure 4:
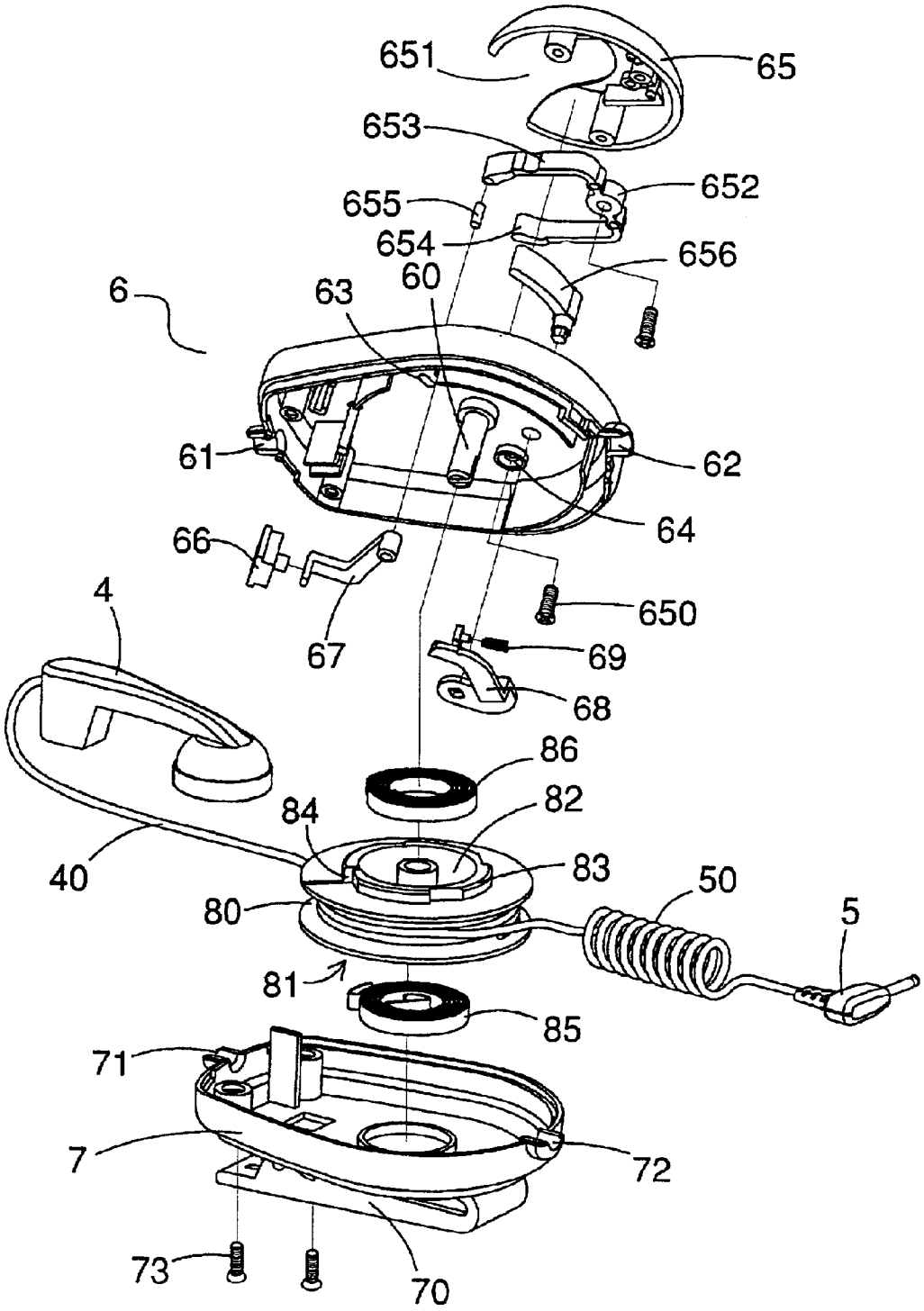
FIG. 4 is a perspective exploded view of the receptacle for earphone cord of the present invention.
Figure 5:
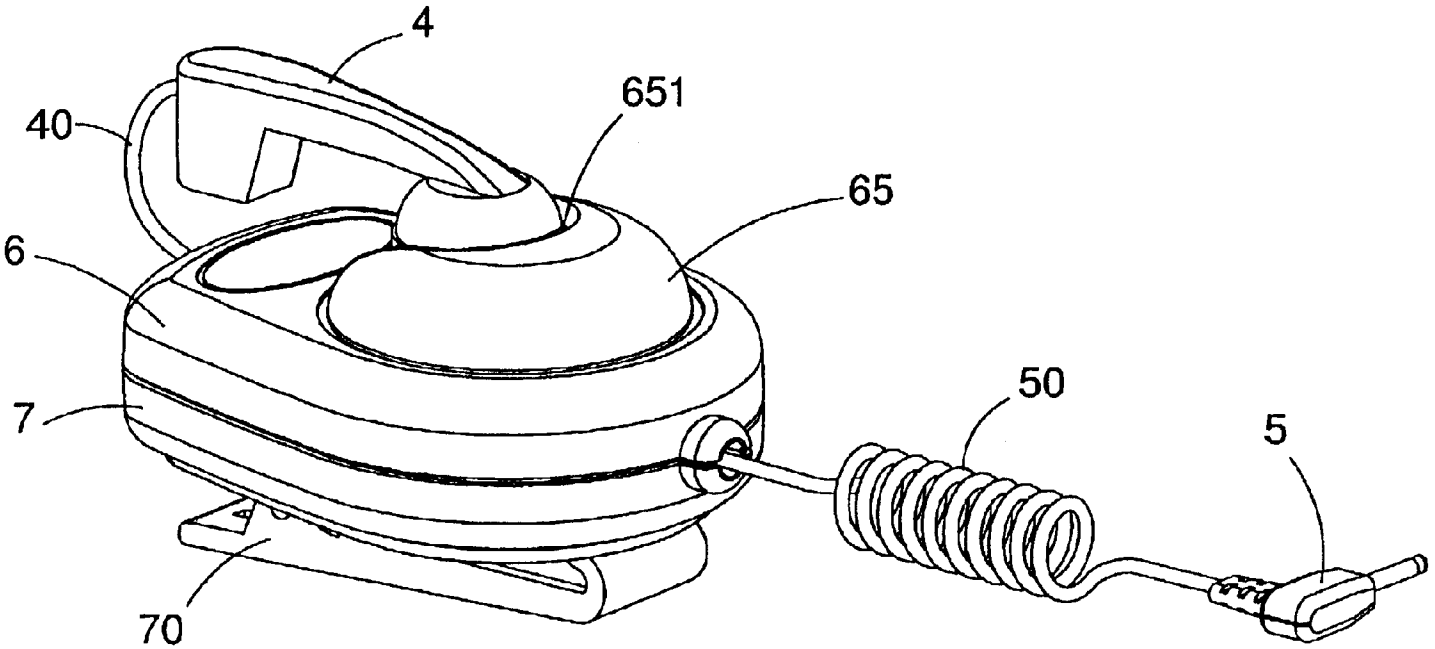
FIG. 5 is a perspective exploded view of the receptacle for earphone cord of the present invention.

Referring to FIGS. 4 and 5, there is shown a receptacle for earphone cord comprising a front shell 6, a rear shell 7 enclosed a rolling disc 8 having a retracting earphone wire 70 and a connecting wire 50, and an earphone seat 65 being provided to the front shell 6.

Figure 6:
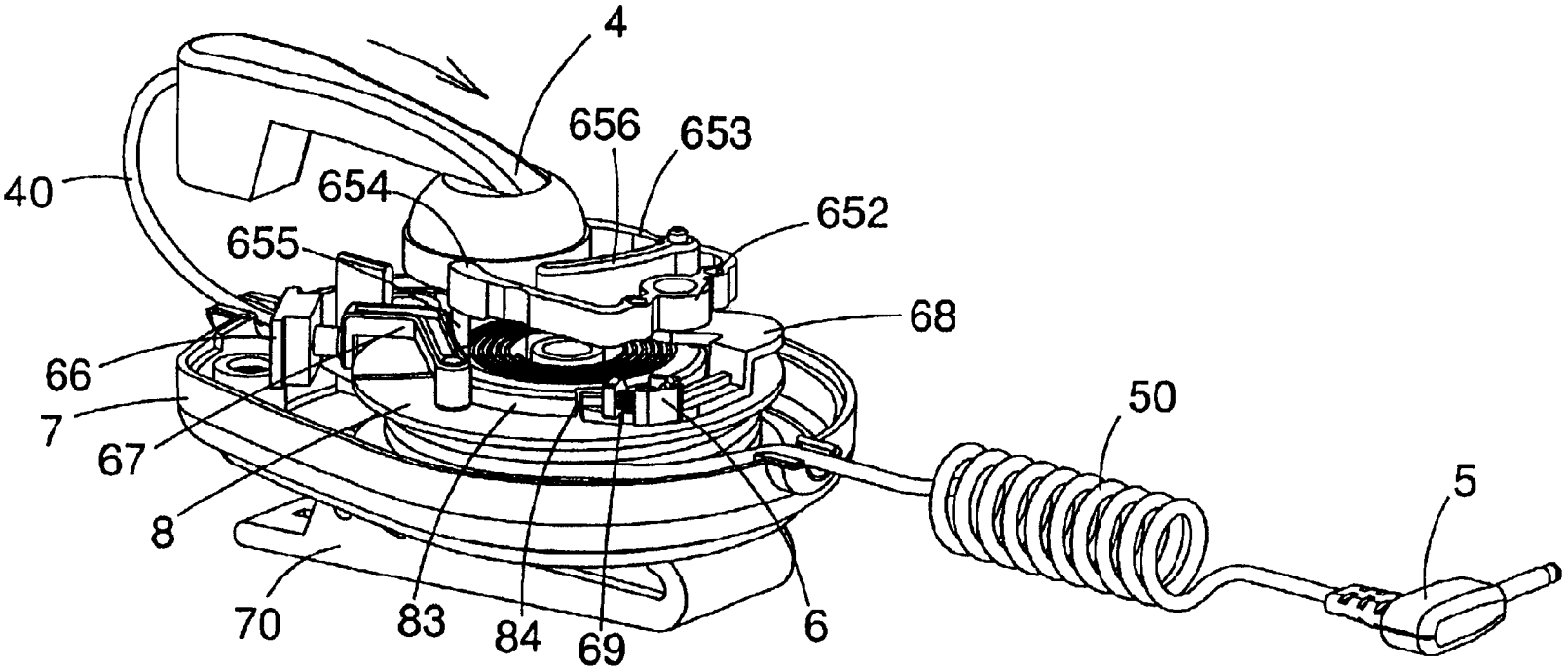
FIG. 6 schematically shows the action of the clipping hook of the receptacle for earphone cord of the present invention.
Figure 7:
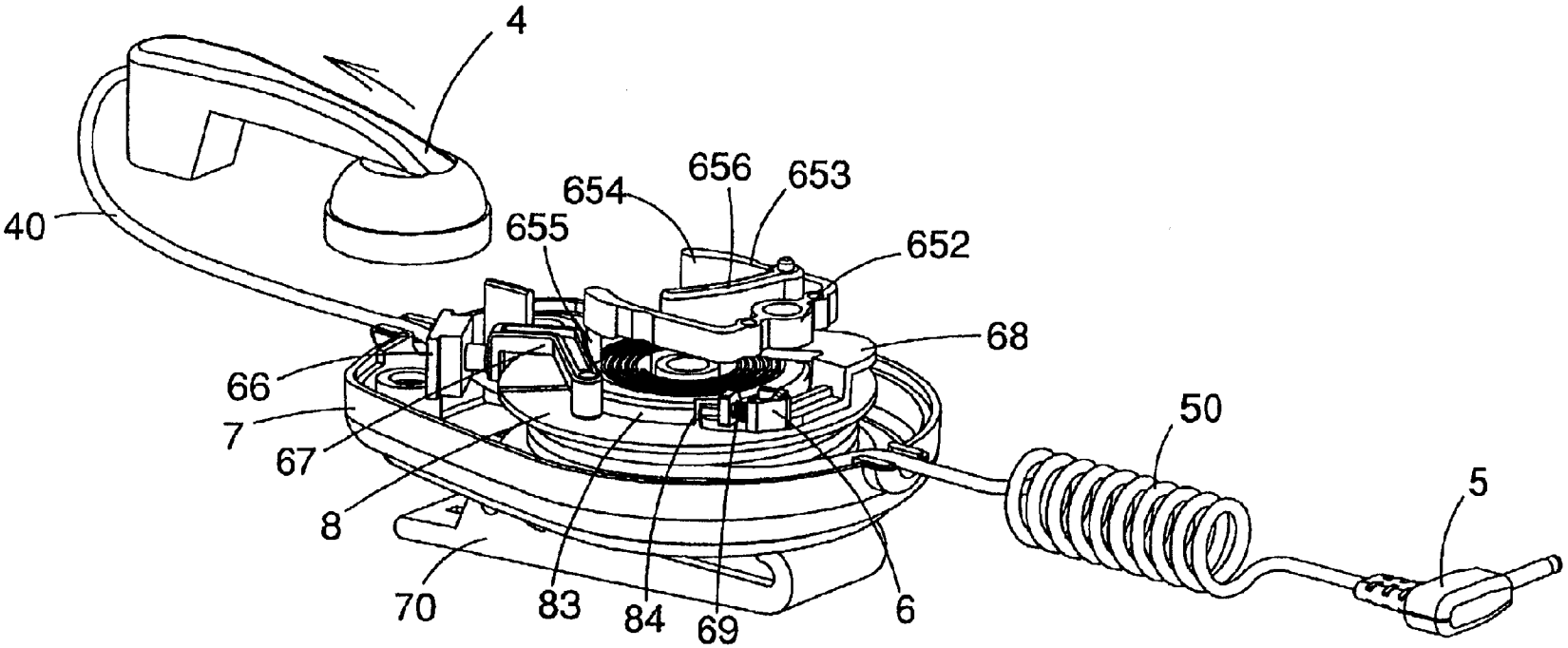
FIG. 7 is a schematic view showing the pulling out of the clipping hook of an improved structure of a receptacle for earphone wire of the present invention.

As shown in FIG. 6 and 7, the front shell 6 has a shaft rod 60 for pivotal mounting of the rolling disc 8, and the top and bottom end of the front shell 6 are provided with a top hole 61 and a bottom hole 62 allowing the passing through of the respective earphone wire 40 and the connecting wire 50. A sliding hole 63 and a pivot hole 64 are also provided on the front shell 6 and the outer side of the front shell 6 is mounted with an earphone seat 65 by means of screw 650. A notch 651 is provided on the earphone seat 65 in combination with the front shell 6 to form an opening to accommodate an earphone 4. A U-shaped clipping hook 652 is provided within the earphone seat 65 and a buttoning section 654 is provided at the end portion of the inner side of the two clipping hooks 653 to allow the earphone 4 to be mounted thereto. A sliding hole 63 passes through the bottom end of one side of the clipping hook 653, in communication to the pulling rod 655 of the front shell 6. The pivot hole 64 of the front shell 6 has a push rod 656 and the push rod 656 can pass through the pivot hole 64 to drive a swinging rod 68 at the inner side of the front shell 6. One end of the swinging rod 68 controls the rotating of the rolling disc 8 and is provided with a spring 69 having one end which presses against the front shell 6. A connection rod 67 is pivotally mounted at the inner side of the front shell 6 and one end of the connection rod 67 presses against the switching button 66 on the front shell 6, and one side of the connection rod 67 allows the pulling rod 655 to urge. Screw 73 is used to mount the rear shell 7 to the front shell 6. A clipping body 70 is provided to the rear shell 7 for the clipping of the receptacle of the present invention onto a belt or the like wore by the user. The top and bottom end of the inner side of the rear shell 7 are provided with a top hole 71 and a bottom hole 72 to combine with the top hole 61 and bottom hole 62 of the front shell 6 to form a through hole for the earphone wire 40 and the connecting wire 50.

The rolling disc 8 is provided circumferentially a rolling recess 80 for the rolling of the earphone wire 40. One side of the rolling disc 8 comprises a spring recess 81 accommodate a rolling-type spring 85 and the other side of the rolling disc 8 comprises a recess 82 to accommodate a soft-coiled wire 86. The outer side of the coiled wire 86 comprises a fastening board 87 mounted on the shaft rod 60 allowing the mounting of the rolling disc 8. A protruded edge 83 is provided on the recess 82 and has a plurality of engaging slots 84 to engage with an interconnection rod 67 at one end. One end of the spring 85 is mounted to the rolling disc 8, and the other end is mounted onto the shaft rod 60.

The soft-coiled wire 86 is located within the recess 82 and has one end connected to the earphone wire 40, and the other end is connected to the connection wire 50 passed through the fastening board 87.

The earphone wire 40 is a cord extended from the earphone 4 being connected to one end of the coiled cord 83.

The connection wire 50 is a wire extended from a connector 5, and the connector 5 can be mounted with the output of a mobile phone or earphone 4 to transmit signals. One end of the connection wire 50 is connected to one end of the soft-coiled wire 50 passing through the fastening board 87.

Figure 8:
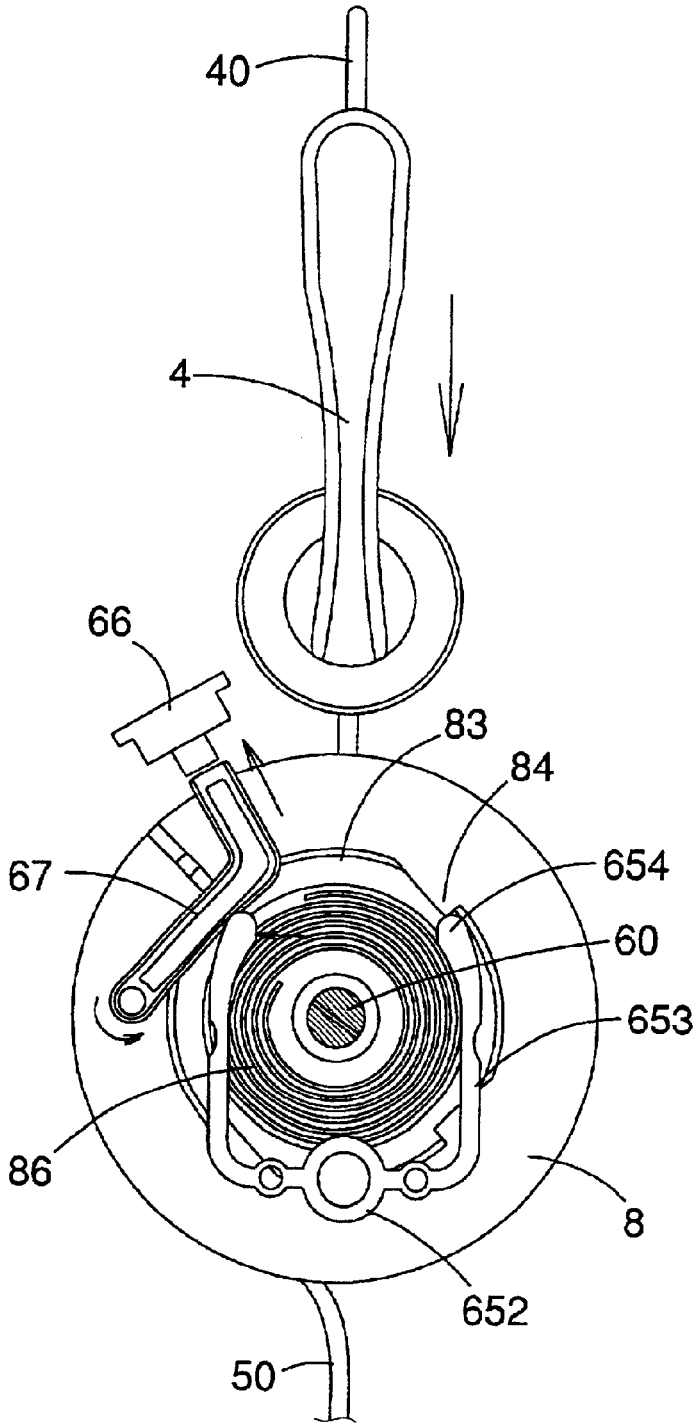
FIG. 8 is a schematic view showing the clipping hook for controlling of the switch of an improved structure of a receptacle for earphone wire of the present invention.
Figure 9:
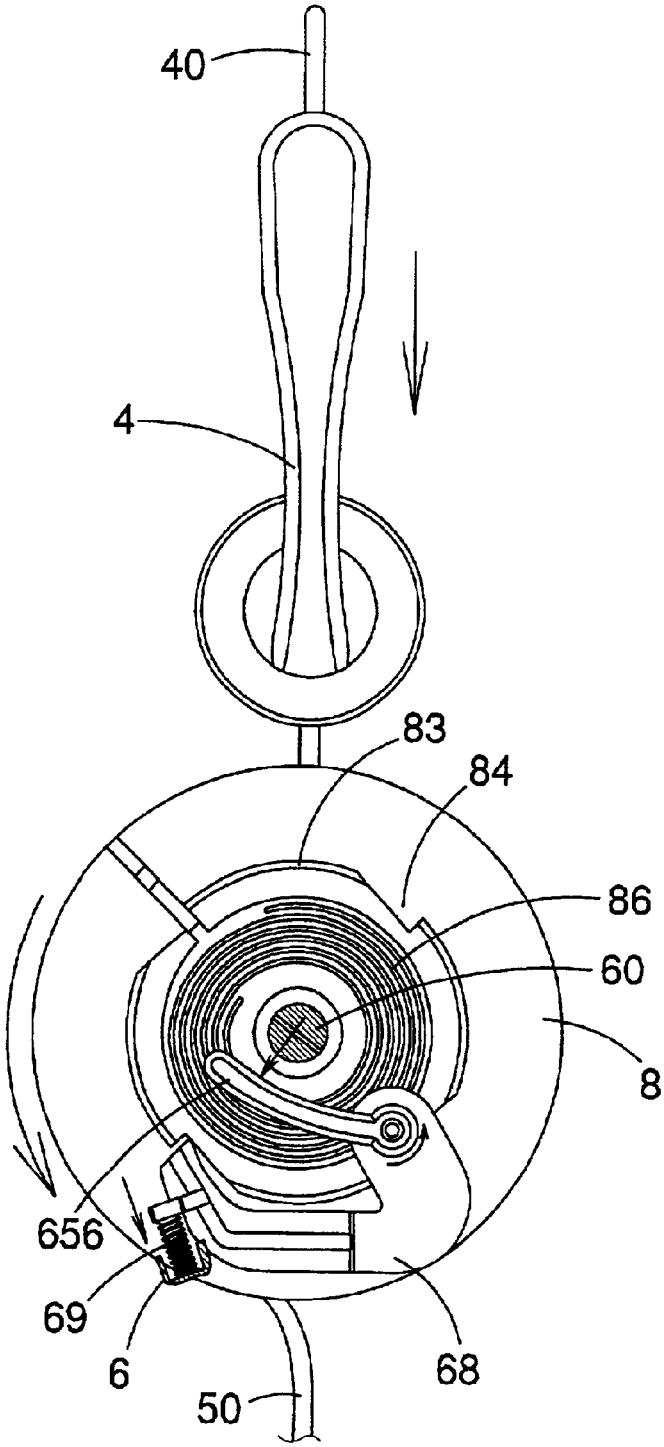
FIG. 9 shows the pulling out of the clipping hook to control the rolling disc of an improved structure of a receptacle for earphone wire of the present invention.

Referring to FIGS. 6, 8 and 9, when the earphone 4 is inserted into the earphone seat 65, the two sides 653 of the clipping hook 622 are extended outward so that the earphone 4 is inserted into the two sides of the hook 653. The restoration force of the hook 653 causes the protruded portion 654 of the hook 653 to restrict the earphone. When the hook 653 is extended outward, the pulling rod 655 pushes the interconnection rod 67 at the side of the front shell 6 and one end of the interconnection rod 67 presses the switching button 66. As shown in FIG. 8, when the earphone 4 is located within the bottom section of the clipping hook 652 the pushing rod 656 swings downward, the swinging rod 68 is dislocated from the engaging slot of the protruded edge 83 and the earphone wire 40 is automatically rolled within the rolling recess 80 due to spring force of the spring 85. The connection wire 50 will not be rotated as the fastening board 87 is pivotally mounted on the shaft axle 60, as shown in FIG. 9. Thus the objectives of automatic switching ON of the earphone and the wire rolling are achieved.

Referring to FIG. 7, when the earphone 4 is withdrawn, the earphone 4 is dislocated from the earphone seat 65 as the protruded section 644 is extended outward. The pulling rod 655 located at one side of the hook 653 will be driven to drive the interconnection rod 67 at the inner side of the front shell 6, and one end of the inter connection rod 67 presses the switching button 66 to switch ON the earphone. When the earphone wire 40 is pulled out subsequently, the rolling disc 8 will rotate and the spring 85 is thus become taut. At the same time, the soft-coiled wire 86 will surround onto the shaft rod 60. When the earphone 40 is released, the engaging slot 84 is engaged by the swinging rod 68 so that the rolling disc 8 cannot rotate in the opposite direction and the earphone wire 40 is thus rolled up. As a result, the objective of switching OFF the earphone is achieved.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiment, but only by the scope of the appended claims.

I claim:

1. An improved structure of a receptacle for earphone wire having a front shell, a rear shell enclosing a rolling disc mounting with an earphone wire, a spring being provided within the rolling disc and one side of the rolling disc being connected to a soft-coiled wire having connected to the earphone wire and a connection wire, an earphone seat being provided to the front shell and a clipping hook being provided within the earphone, characterized in that the front shell contains a switching button, an interconnection rod urged against the switching button and a swinging rod which can actuate the rolling disc, and a pulling rod passed through the front shell capable of triggering the interconnection rod is provided to the clipping hook, the earphone seat is provided with a pushing rod pivotally mounted at the front shell, and the pushing rod passes through the front shell and interconnects with the swinging rod, thereby the withdrawing out or inserting in the earphone can control the switching button of the earphone or the rotating of the rolling disc so that the earphone can be automatically switched ON or switched OFF.

2. The improved structure of a receptacle for earphone wire of claim 1, wherein a shaft axle is provided to the front shell allowing the pivotal mounting of the rolling disc, the earphone wire and the connection wire pass through the top hole and bottom hole provided on a top and bottom end of the front shell, a sliding hole is provided to the front shell along the pulling rod to pass through and slide within the sliding hole, and a pivot hole is provided to the front shell for the pivotal mounting of the pushing rod, and the interconnection rod is pivotally mounted on the inner side of the front shell.

3. The improved structure of a receptacle for earphone wire of claim 1, wherein the pulling rod passed through the sliding hole and which presses against one side of the interconnection rod.

4. The improved structure of a receptacle for earphone wire of claim 1, wherein the swinging rod is pivotally mounted on the pushing rod, and one end of the swinging rod is a spring having one end which presses against the front shell.

5. The improved structure of a receptacle for earphone wire of claim 1, wherein a clipping body is provided to the mounting of the front and the rear shell, and top and bottom holes are respectively formed at the top end and bottom end of the combination of the front shell and the bottom shell allowing the earphone wire and the connection wire to pass through.

6. The improved structure of a receptacle for earphone wire of claim 1, wherein the rolling disc is provided circumferentially comprising a rolling recess for the rolling of the earphone wire, one side of the rolling disc comprises a spring recess to accommodate a rolling-type spring and the other side of the rolling disc comprises a recess to accommodate a soft-coiled wire, and the outer side of the coiled wire comprises a fastening board mounted on the shaft rod, allowing the mounting of the rolling disc, and a protruded edge is provided on the recess and has a plurality of engaging slots to engage with an interconnection rod at one end, and one end of the spring is mounted to the rolling disc, and the other end is mounted onto the shaft rod.

7. The improved structure of a receptacle for earphone wire of claim 1, wherein the connection wire is a wire extended from a connector, which can be mounted to the output of a mobile phone or earphone to transmit signals, and one end of the connection wire is connected to one end of the soft-coiled wire passing through the fastening board.

* * * * *